US009840932B2

(12) United States Patent
Ballard, Jr. et al.

(10) Patent No.: US 9,840,932 B2
(45) Date of Patent: Dec. 12, 2017

(54) SYSTEM AND METHOD FOR BLADE TIP CLEARANCE CONTROL

(71) Applicant: General Electric Company, Schenectady, NY (US)

(72) Inventors: Henry Grady Ballard, Jr., Easley, SC (US); Brett Darrick Klingler, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 540 days.

(21) Appl. No.: 14/507,659

(22) Filed: Oct. 6, 2014

(65) Prior Publication Data

US 2016/0097296 A1 Apr. 7, 2016

(51) Int. Cl.
*F01D 11/24* (2006.01)

(52) U.S. Cl.
CPC ..... *F01D 11/24* (2013.01); *F05D 2260/213* (2013.01); *F05D 2270/301* (2013.01); *F05D 2270/303* (2013.01); *F05D 2270/44* (2013.01); *F05D 2300/5021* (2013.01)

(58) Field of Classification Search
CPC ..... F01D 11/24; F01D 5/081; F01D 11/14; F01D 11/18; F01D 11/20; F01D 25/08; F05D 2300/5021; F05D 2260/213; F05D 2270/303; F05D 2270/44; F05D 2270/301; F02C 7/185; F02C 9/18
See application file for complete search history.

(56) References Cited

U.S. PATENT DOCUMENTS 4,507,914 A * 4/1985 Rice ..... F01D 5/185 415/114
5,611,197 A * 3/1997 Bunker ..... F02C 7/185 415/115
6,050,079 A * 4/2000 Durgin ..... F02C 7/125 415/115
6,065,282 A * 5/2000 Fukue ..... F02C 7/185 415/115
6,676,372 B2 1/2004 Scholz et al.
7,096,673 B2 8/2006 Little et al.
7,909,566 B1 3/2011 Brostmeyer
8,126,628 B2 * 2/2012 Hershey ..... F01D 11/24 244/75.1
8,177,476 B2 * 5/2012 Andrew ..... F01D 11/14 415/1
8,449,243 B2 5/2013 Fiala et al.
8,973,371 B2 * 3/2015 King ..... F01D 5/081 60/782
9,091,173 B2 * 7/2015 Mosley ..... F01D 5/082
(Continued)

*Primary Examiner* — Gregory Anderson
*Assistant Examiner* — Eldon Brockman
(74) *Attorney, Agent, or Firm* — Fletcher Yoder P.C.

(57) ABSTRACT

A system includes a turbomachine rotor having a shaft and turbomachine blades coupled to the shaft. The system also includes a turbomachine stator having a shroud surrounding the turbomachine blades of the turbomachine rotor. Further, the system includes a cooling channel having at least a first portion of the cooling channel extending upstream of a final stage of a compressor of the system, where the cooling channel is configured to receive cooled compressed air from the compressor and direct the cooled compressed air adjacent to the turbomachine rotor to reduce thermal expansion and/or axial displacement of the turbomachine rotor.

20 Claims, 4 Drawing Sheets

(56) References Cited

U.S. PATENT DOCUMENTS

| | | | | |
|---|---|---|---|---|
| 9,316,152 | B2 * | 4/2016 | Subbareddyar | F02C 7/18 |
| 2009/0037035 | A1 * | 2/2009 | Hershey | F01D 11/24 701/3 |
| 2010/0247283 | A1 * | 9/2010 | Andrew | F01D 11/14 415/1 |
| 2011/0088405 | A1 * | 4/2011 | Turco | F01D 5/081 60/782 |
| 2012/0060507 | A1 * | 3/2012 | King | F01D 5/081 60/782 |
| 2013/0219918 | A1 * | 8/2013 | Suciu | F01D 5/081 60/782 |
| 2013/0323010 | A1 * | 12/2013 | Mosley | F01D 25/12 415/1 |
| 2013/0336757 | A1 * | 12/2013 | Subbareddyar | F02C 7/18 415/1 |

* cited by examiner

SYSTEM AND METHOD FOR BLADE TIP CLEARANCE CONTROL

BACKGROUND

The subject matter disclosed herein relates to a system and method for reducing blade tip clearances of turbomachines. In particular, the present disclosure relates to a system and method for reducing blade tip clearances by controlling axial displacement of turbomachine components.

Traditionally, turbomachines include a turbine with rotating blades within a stationary turbomachine shroud. A clearance may be included between a tip of each blade and the turbomachine shroud. This clearance may be referred to as a blade tip clearance. Blade tip clearances enable combustion gases passing through the turbomachine to leak over the tips of the blades, between the blade tips and the turbomachine shroud. Leakage of combustion gases in this manner may reduce an overall efficiency of the turbomachine system, and particularly the turbomachine itself. Thus, it is now recognized that there is a need for a system and method for improving, reducing, or eliminating blade tip clearances.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbomachine rotor having a shaft and turbomachine blades coupled to the shaft. The system also includes a turbomachine stator having a shroud surrounding the turbomachine blades of the turbomachine rotor. Further, the system includes a cooling channel having at least a first portion of the cooling channel extending upstream of a final stage of a compressor of the system, where the cooling channel is configured to receive cooled compressed air from the compressor and direct the cooled compressed air adjacent to the turbomachine rotor to reduce thermal expansion and/or axial displacement of the turbomachine rotor.

In a second embodiment, a method for reducing blade tip clearances of a turbomachine includes diverting a first portion of compressed air to a heat exchanger during certain stages of operation of the turbomachine and cooling the first portion of compressed air via the heat exchanger to generate a cooled compressed air. The method also includes routing the cooled compressed air through a channel proximate a rotor of the turbomachine, where the channel includes at least a first portion of the channel extending upstream of a final stage of a compressor of the turbomachine. Further, the method includes cooling the rotor to effectuate a reduction in thermal expansion and/or axial displacement of the rotor to reduce a blade tip clearance between a blade of the turbomachine and a stator of the turbomachine.

In a third embodiment, a system includes a turbomachine rotor having a shaft and turbomachine blades coupled to the shaft. The system also includes a turbomachine stator having a shroud surrounding the turbomachine blades of the turbomachine rotor. Further, the system includes a cooling channel having at least a first portion of the cooling channel extending upstream of a final stage of a compressor of the system, where the cooling channel is configured to receive cooled compressed air from the compressor and direct the cooled compressed air adjacent to the turbomachine rotor to reduce thermal expansion and/or axial displacement of the turbomachine rotor. The system also includes a control system. The control system is configured to selectively enable fluid communication between the compressor and the cooling channel. The control system includes a valve disposed between the compressor and the cooling channel, where the valve is configured to be selectively opened to enable fluid communication between the compressor and the cooling channel based on an operating condition or stage of operation of the turbomachine system. The control system also includes a sensor disposed proximate the cooling channel and configured to detect a parameter relating to the operating condition of the turbomachine system. Further, the control system includes a controller configured to receive the parameter relating to the operating condition or stage of operation of the turbomachine system and, based on the operating condition or stage of operation, selectively open or close the valve to enable fluid communication between the compressor and the cooling channel.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
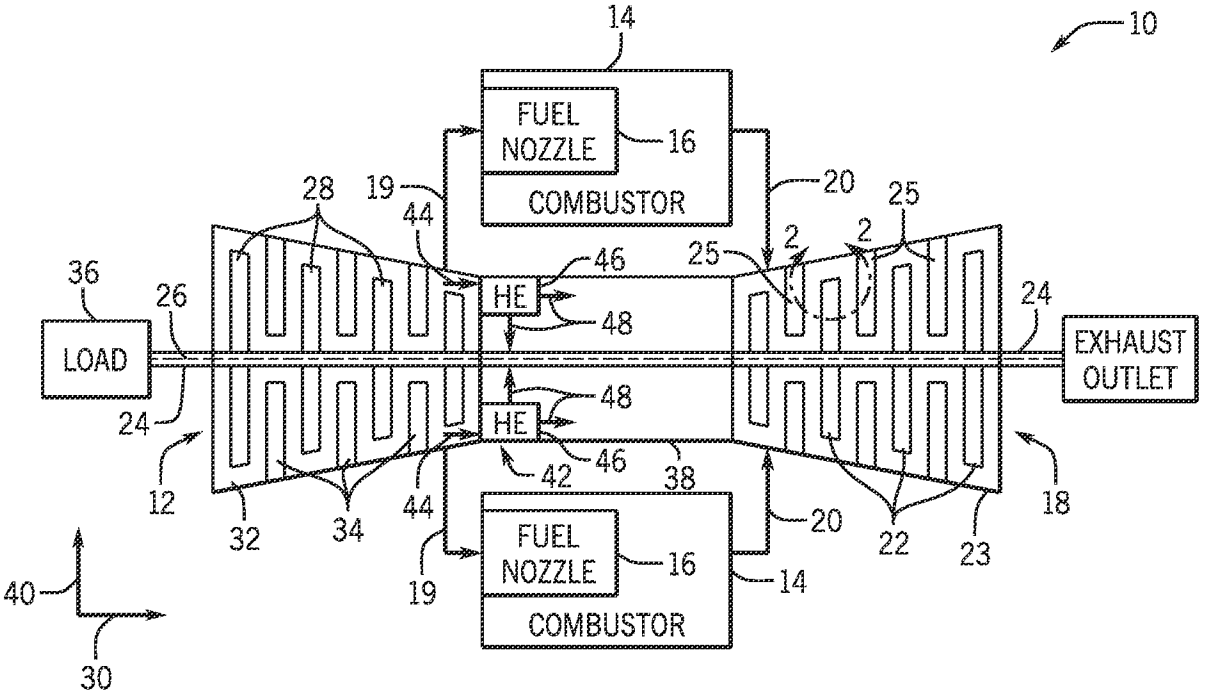
FIG. 1 is a schematic diagram of an embodiment of a turbomachine system having an axial displacement control system, in accordance with aspects of the present disclosure.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure include a turbomachine (e.g., a turbomachine system) having a turbomachine stator and a turbomachine rotor. The turbomachine may include a compressor and/or a turbine, such as a gas turbine, a steam turbine, a hydro turbine, or any combination thereof. In the following discussion, embodiments of a clearance control system are discussed in context of a gas turbine, but are equally applicable to other types of turbines as well.

The stator of the turbomachine is stationary and may include a compressor shroud, compressor vanes, a turbine shroud, turbine vanes, and an optional transition shroud between the compressor shroud and turbine shroud. The rotor may include a shaft and compressor blades and turbine blades coupled to the shaft, where the rotor components rotate about a rotational axis extending through the shaft. A compressor of the turbomachine system includes the compressor shroud, compressor vanes of the stator, and the compressor blades of the rotor, while a turbine of the turbomachine system includes at least the turbine shroud and turbine vanes of the stator and the turbine blades of the rotor. The compressor blades and compressor vanes alternate in stages along the rotational axis, and the turbine blades and turbine vanes alternate in stages along the rotational axis. The shaft of the rotor extends through both the compressor and the turbine and, as previous described, is coupled to the compressor blades and turbine blades. Thus, as the shaft rotates, so too do the compressor blades and turbine blades, where each stage of the compressor blades and turbine blades are disposed between stages of the compressor vanes and turbine vanes, respectively. However, it should be noted that, in accordance with present embodiments, the turbine may be a multishaft turbine. For example, a separate shaft (e.g., a load shaft) may be coupled between the turbine and a load, such that rotation of the turbine blade rotates the load shaft to drive the load. Any number of shafts may be included in the turbine for rotating various components of the turbine.

The turbine blades may cut into or physically contact an adradable structure such as metallic honeycomb. The honeycomb structure may be disposed on the stationary turbine shroud while the turbine blades rotate with the shaft during operation. By contacting the honeycomb structure during operation (e.g., during rotation), the turbine blades block hot combustion gases being routed through the turbine from leaking over tips of the turbine blades between the turbine blades and the honeycomb structure disposed on the turbine shroud. However, due to thermal expansion of various components of the turbomachine, the turbine blades may axially separate from the honeycomb structure during various operating conditions or stages of operation (e.g., in an axial direction parallel to the rotational axis). The distance between the tip of each blade and the honeycomb structure of the stationary turbine shroud, while the turbine blade tip is separated from the honeycomb structure, may be referred to as a blade tip clearance. An axial blade tip clearance (e.g., longitudinal blade tip clearance) may refer to a blade tip clearance measured axially from the blade tip to the honeycomb structure, i.e., in the axial direction relative to the rotational axis. A radial blade tip clearance may refer to a blade tip clearance measured radially from the blade tip to the honeycomb structure, i.e., in a radial direction perpendicular to the rotational axis.

To reduce or eliminate blade tip clearances (in particular, axial blade tip clearances), embodiments of the present disclosure include an axial displacement control system, or control system for short. The axial displacement control system may control axial displacement of various turbomachine components of the stator and/or rotor at least in part by utilizing compressed air or a portion of compressed air generated by the compressor, or some other type of coolant, such as an inert gas (e.g., nitrogen), or any other gas, liquid, or vapor. In particular, the axial displacement control system may control axial displacement of portions of the rotor with respect to the stator. For example, a portion of the compressed air generated by the compressor may be exported to a heat exchanger for cooling. The portion of compressed air may then be cooled and routed proximate portions of the rotor for cooling the rotor. By cooling the rotor with the cooled compressed air, the axial displacement of the rotor may be reduced compared to embodiments where the rotor is not cooled with the cooled compressed air. In turn, by cooling the rotor, the axial displacement of the turbine blades, which are coupled to or, in other words, are a part of the rotor, is also reduced. By reducing axial displacement of the turbine blades, blade tips of the turbine blades may remain in contact with the honeycomb structure. In other words, by reducing axial displacement of the turbine blades, axial blade tip clearance may be reduced or eliminated.

The control system may also control axial displacement of other components of the turbomachine besides the rotor. For example, the control system may substantially divert the cooled compressed air only to the rotor, or mostly to the rotor, such that the stator is allowed to heat and expand. Thus, while the turbine blades of the rotor "contract" opposite the axial direction into the honeycomb structure disposed on the turbine shroud (or, more accurately, are blocked from expanding away from the honeycomb structure in the axial direction), the turbine shroud (of the stator) may thermally expand in the axial direction into the blades (of the rotor) to further facilitate closure of the axial blade tip clearance. Indeed, other mechanisms may be utilized for ensuring that the stator thermally expands more so than the rotor. For example, specific materials may be selected for turbine components proximate the area that is cooled by the cooled compressed air. Materials of rotor components may have a low coefficient of thermal expansion and materials of stator components may have a high coefficient of thermal expansion, at least relative to one another. For example, steel alloys with varying amounts of Iron, Aluminum, Boron, Carbon, Chromium, Cobalt, Copper, Lead, Manganese, Molybdenum, Nickel, Phosphorus, Silicon, Sulfur, Tantalum, Titanium, Thallium, Tungsten, and Zirconium may be used for components of the rotor and/or stator. Common names for such alloys include Stainless Steel, Inconel, and Chrom-Moly Alloys. By selecting appropriate materials, thermal expansion of the rotor in the axial direction may be reduced compared to thermal expansion of the stator in the axial direction, which may reduce blade tip clearances as set forth in the present disclosure.

By thermally expanding in the axial direction, the stator (or, more specifically, the honeycomb structure disposed on the stator) may be axially displaced into the tips of the turbine blades. By varying between, or simultaneously facilitating, (a) cooling of the rotor and (b) heating of the stator, the rotor and corresponding turbine blades are blocked from axial growth away from the stator and the stator axially expands into or toward the turbine blades of the rotor. The control system may, depending on operating conditions or stages of operation, determine if, when, and/or how much rotor cooling and/or stator heating (or simply less or no cooling) is appropriate or desirable. The control system and turbomachine components will be described in detail below with reference to the figures.

Turning now to the figures, FIG. 1 is a schematic diagram of an embodiment of a turbomachine system 10 having a compressor 12, combustors 14, fuel nozzles 16, and a turbine 18. The fuel nozzles 16 route a liquid fuel and/or gas fuel, such as natural gas or syngas, into the combustors 14. The combustors 14 also receive compressed air 19 generated by the compressor 12 for mixing with the fuel, and the combustors 14 ignite and combust the fuel-air mixture. Hot, pressurized combustion gases 20 (e.g., exhaust) are then passed from the combustors 14 into the turbine 18. The turbine 18 includes turbine blades 22 and a turbine shroud 23, where the turbine blades 22 are coupled to a rotary shaft 24, and the turbine shroud 23 is stationary with respect to the shaft 24 and the turbine blades 22. Coupled to the turbine shroud 23 are a number of turbine vanes 25, which direct or alter flow (e.g., by controlling pressure/velocity of the flow) of the hot pressured combustion gases 20 between each set of turbine blades 22. Thus, as the hot pressurized combustion gases 20 pass through the turbine 18, the turbine blades 22 of the turbine 12 rotate and drive the shaft 24 into rotation, and the turbine vanes 25 prepare the hot pressured combustion gases 20 for each successive stage of turbine blades 22.

The shaft 24 also extends through the compressor 12, among other components of the system 10, and rotates about a rotational axis 26 extending through the shaft 24. The compressor 12 comprises a number of compressor blades 28 which are coupled to the shaft 24. Thus, as the shaft 24 rotates via driven rotation of the turbine blades 22 as described above, the compressor blades 28 also rotate. The compressor 12 is configured to receive air (e.g., ambient air), and the air is compressed in the compressor 12 as the blades 28 of the compressor 12 rotate and as a cross-sectional area of the compressor 12 decreases in an axial direction 30 of the compressor 12 parallel to the rotational axis 26. Similar to the turbine 18, the compressor 12 also includes a compressor shroud 32, which is stationary with respect to the shaft 24 and the compressor blades 26. The compressor 12 likewise includes compressor vanes 34, which may redirect or alter pressure/velocity of the flow of air through the compressor 12 as the air is compressed. The compressor vanes 34 may be coupled to the compressor shroud 32, such that the compressor vanes 34 are stationary with respect to the rotating shaft 24 and components coupled to the shaft 24 (e.g., the compressor blades 28 and turbine blades 22).

Ultimately, the turbomachine system 10 may drive a load 36, which may be coupled to the shaft 24 or to a separate shaft that is coupled to a final stage of the blades 22 of the turbine 18. In other words, in some embodiments, some of the blades 22 of the turbine 18 may be used for driving the shaft 24, the compressor 12, and the turbine 18, while others of the blades 22 may be used for driving a different shaft that drives the load 36. In the illustrated embodiment, for clarity, the shaft 24 is coupled to all rotary components of the illustrated schematic gas turbine engine 10, including the load 36.

Often, the rotary or rotating components of the turbomachine system 10 are collectively referred to as a rotor. The rotor in the illustrated embodiment, for example, may include at least the shaft 24, the compressor blades 28, and the turbine blades 22. Further, stationary components of the turbomachine system 10 are often referred to, collectively, as a stator. The stator in the illustrated embodiment, for example, may include at least the compressor shroud 32, the compressor vanes 34, the turbine shroud 23, the turbine vanes 25, and optionally a transition shroud 38 disposed between the compressor shroud 32 and the turbine shroud 23. In some embodiments, the optional transition shroud 38 may be replaced with a rotating cover (which may be a part of the rotor) or may not be included at all. For example, in some embodiments, the compressor shroud 32 may seamlessly transition into the turbine shroud 23, or the compressor shroud 32 and the turbine shroud 23 may be disposed proximate each other.

To enhance efficiency of the turbine 18, clearance between the stationary turbine shroud 23 and tips of the turbine blades 22 may be reduced. This clearance may be referred to as a blade tip clearance. Blade tip clearance may actually include two components: axial blade tip clearance and radial blade tip clearance. Axial blade tip clearance may refer to a distance between the tip of the blade 22 and the turbine shroud 23 measured in the axial direction 30. Radial blade tip clearance may refer to a distance between the tip of the blade 22 and the turbine shroud 23 measured along a radial direction 40, generally perpendicular to the axial direction 30. In the illustrated embodiment, an axial displacement control system 42 may be utilized for controlling axial displacement of rotor and/or stator components. In doing so, axial blade tip clearance may be reduced or negated, although this may, as set forth below, simultaneously reduce the radial blade tip clearance component as well. The axial displacement control system 42, for example, may export a portion 44 of the compressed air 19 (or some other coolant, such as an inert gas (e.g., nitrogen, steam, vapor, water, refrigerant, etc.)) to a heat exchanger 46 (e.g., a direct heat exchanger and/or an indirect heat exchanger using a liquid or gas coolant), which may cool the portion 44 of compressed air 19, generating cooled compressed air 48. The cooled compressed air 48 may then be used to cool components of the rotor. For example, the cooled compressed air 48 may be used to cool the shaft 24 at locations within the transition shroud 38. Alternatively or additionally, the cooled compressed air 48 may be used to cool compressor blades 28 proximate the control system 42. Further, the cooled compressed air 48 may be used to cool the shaft 24 closer to the turbine 18 or may be used to cool rotor components proximate a connection of the blades 22 of the turbine 18 to the shaft 24. However, in general, the cooled compressed air 48 may be directed to an area substantially defined upstream of the turbine 18. Indeed, cooling components within the turbine 18 (e.g., the turbine blades 22 or discs thereof) or too far downstream within the turbine 18 may lead to the turbine blades 22 contracting radially away from the turbine shroud 23 toward the shaft 24, increasing blade tip clearances.

By cooling components of the rotor, thermal expansion of the rotor components in the axial direction 30 may be reduced. Thus, the turbine blades 22 may be blocked from extending away from contact with the turbine shroud 23 (or honeycomb structure thereof) in the axial direction 30. For example, by cooling the shaft 24, thermal expansion of the shaft 24 in the axial direction 30 is reduced. Since the turbine blades 22 are coupled to the shaft 24, the turbine blades 22 likewise are not displaced, or have a reduced displacement, in the axial direction 30. Because the turbine shroud 23 gradually increases in cross-sectional area (e.g., a tapered annular wall) in the axial direction 30, displacement of the turbine blades 22 in the axial direction 30 cause the turbine blades 22 to separate from the turbine shroud 23 (or honeycomb structure disposed on the turbine shroud 23). By blocking thermal expansion of the shaft 24, separation of the turbine blades 22 from the honeycomb structure of the shroud 23 is reduced or eliminated. Further, because the cooled compressed air 48 is output from the heat exchanger 46 mostly to portions of the rotor of the turbomachine system 10, as opposed to the stator, the stator (e.g., the turbine shroud 23 and the turbine vanes 25) may be allowed to thermally expand in the axial direction 30 toward the turbine blades 22. Thus, the honeycomb structure disposed on the turbine shroud 23 or proximate the turbine shroud 23 may be axially displaced into tips of the turbine blades 22.

It should be noted that the control system 42 may selectively utilize techniques described above based on certain operating conditions or stages of operation. For example, during certain operating intervals (e.g., stages of operation), it may be less beneficial to actively reduce or actively eliminate blade tip clearances than during other operation intervals. Indeed, during some operation intervals, blade tip clearances may be eliminated without the use of the control system 42 at all. Thus, the portion 44 of the compressed air 19 exported to the heat exchanger 46 may be exported to the heat exchanger 46 particularly during certain operating intervals (e.g., stages of operation) where blade tip clearances may benefit from rotor cooling. For example, the control system 42 may export the portion 44 of the compressed air 19 to the heat exchanger 46 for cooling rotor components when the turbomachine system 10 is at full speed no load, i.e., the turbomachine system 10 is running at full speed but is not coupled to the load 36. Alternatively, the control system 42 may export the portion 44 of the compressed air 19 to the heat exchanger 46 for cooling rotor components during other intervals of operation, such as during all intervals of start-up between full speed no load and steady state operation. Further, depending on operating conditions (or stages of operation), the control system 42 may export a certain amount of compressed air 19 to the heat exchanger 46 and may cool the compressed air 19 to a certain extent depending on operational inputs taken into account by the control system 42. The control system 42 and the various components which may be controlled via the control system 42 will be described in detail below, with reference to later figures.

Figure 2:
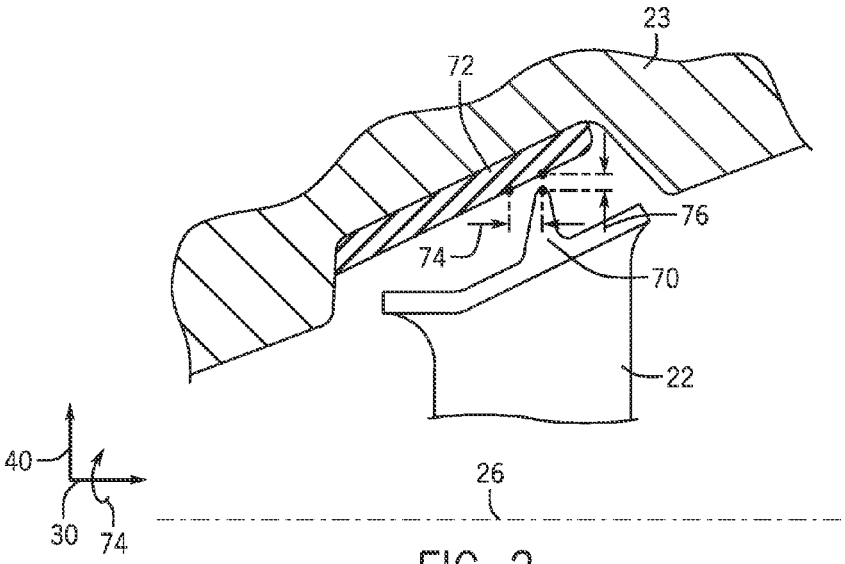
FIG. 2 is a cross-sectional side view of an embodiment of a turbomachine blade and a honeycomb structure disposed on a turbine shroud, in accordance with aspects of the present disclosure.
Figure 3:
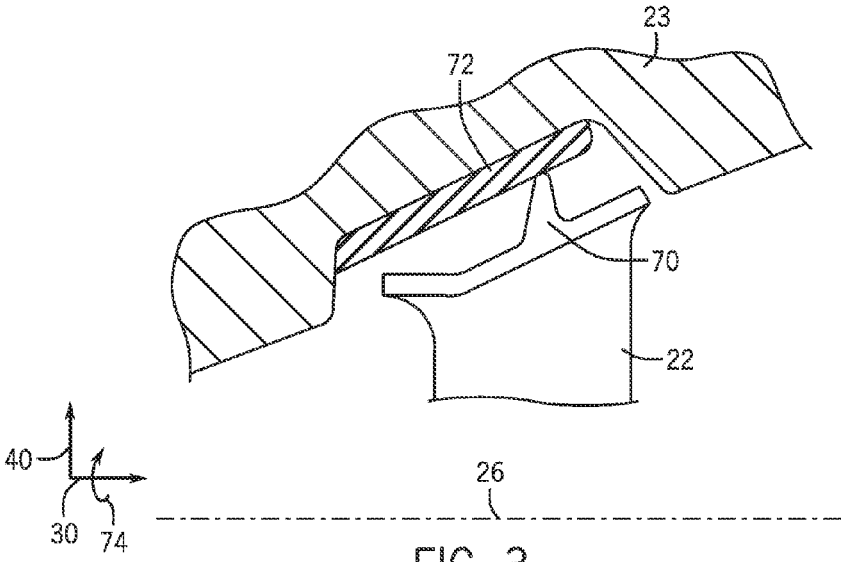
FIG. 3 is a cross-sectional side view of an embodiment of the turbomachine blade and the honeycomb structure of FIG. 2, without a blade tip clearance, in accordance with aspects of the present disclosure.

Turning now to FIGS. 2 and 3, cross-sectional side views of one turbine blade 22 and a portion of the turbine shroud 23 is shown, taken within lines 2-2 of FIG. 1. FIGS. 2 and 3 are intended to clarify certain aspects of blade tip clearances relative to components of the turbomachine system 10 proximate the blade tip clearance. Focusing on FIG. 2, a tip 70 of the blade 22 is shown slightly separated from a honeycomb structure 72 disposed on a portion of the turbine shroud 23, where the honeycomb structure 72 is a softer material (e.g., adradable material) than the tips 70 of the blades 22. For example, the honeycomb structure 72 may include any adradable material. The honeycomb structure 72 may include a base material having a nickel base foil (Nickel-16Chromium-4.5Aluminum-3.5Iron), with or without a gel aluminizing coating. Other embodiments of the honeycomb structure 72 may include a porous metallic material with polyester pore formers that are burned after ignition and mixed with metallic powders (e.g., MCrAlY or Cobalt/Nickel-Chromium-Aluminum-Yttrium), where the polyester pore formers may be applied via plasma spray. In some embodiments, soft metals such as Ni, Graphite, and/or Al may be used for the adradable material of the honeycomb structure 72. Further, foam metals may be used.

In accordance with present embodiments, the honeycomb structure 72 may be conical or cylindrical in shape. For example, the illustrated honeycomb structure 72 is conical, such that axial thermal displacement of stator/rotor components may cause the blade tips 70 to move axially (e.g., opposite to direction 74) into the conical honeycomb structure 72, or cause the turbine shroud 23 to move axially (e.g., in direction 74) into the blade tips 70, as shown in FIG. 3. However, the honeycomb structure 72 may also be any other shape configured to enable the tips 70 of the blades 72 to cut into the honeycomb structure 72 during both transient and steady state operation. For example, some embodiments may include a cylindrical honeycomb structure 72 that is not sloped as shown in the illustrated embodiment. During transient operation, the blade tip 70 may carve out a trench in a certain portion of the honeycomb structure 72 (e.g., cylindrical honeycomb structure 72). During steady state operation, the blade tip 70 may be enabled to contact untrenched honeycomb (e.g., a different portion) of the honeycomb structure 72, by way of stator and/or rotor axial thermal expansion control, in accordance with present embodiments. Accordingly, the honeycomb structure 72 may give way to the tips 70 of the blades 22 such that the blades 22 cut into the honeycomb structure 72, during both transient and steady state operation. Thus, blade tip clearances are reduced during transient and steady state operation or loading. Further, the honeycomb structure 72 (e.g., the adradable material) generally enables rotation of the turbine blade 22 without exerting substantial resistance against the rotation of the turbine blade 22. As previously described, the turbine blade 22, during operation, may be rotating as a component of the rotor. In the illustrated embodiment, the turbine blade 22 may rotate in a first circumferential direction 74, about the rotational axis 26.

The illustrated tip 70 of the turbine blade 22 is separated from the honeycomb structure 72, such that a clearance exists between the tip 70 and the honeycomb structure 72. The clearance may include an axial component (e.g., an axial clearance 74) and a radial component (e.g., a radial clearance 76). The axial clearance 74 and the radial clearance 76 may both be eliminated or reduced in one of two ways. Moving the turbine blade 22 and the honeycomb structure 72 closer together in the axial direction 30, such that the blade tip 70 and the honeycomb structure 72 come into contact, eliminates both axial clearance 74 and radial clearance 76. Moving the turbine blade 22 and the honeycomb structure 72 closer together in the radial direction 40, such that the blade tip 70 and the honeycomb structure 72 come into contact, also eliminates both axial clearance 74 and radial clearance 76. Indeed, reduction of the blade tip clearances 74, 76 in both of the above described manners is made possible by the angled orientation of the honeycomb structure (e.g., tapered annular structure about axis 26) and the increasing cross-sectional area of the turbine shroud 23 in the axial direction 30.

Embodiments of the present disclosure are concerned with utilizing the control system 42 to bring the honeycomb structure 72 and the turbine blade 22 tip 70 together in the axial direction 30, although some thermal expansion and/or contraction of components may also occur in the radial direction 40. This may be achieved by reducing or eliminating thermal expansion of the turbine blade 22 by cooling rotor components which the turbine blade 22 is coupled to, e.g., the shaft 24 (not shown) of the rotor. Alternatively or additionally, eliminating blade tip clearance may be achieved by effecting thermal expansion of the stator (e.g., the turbine shroud 23 of the stator) in the axial direction 30, such that the honeycomb structure 72 disposed on the turbine shroud 23 may be axially displaced into the tip 70 of the turbine blade 22. This may be achieved by the use of the control system 42, as set forth in detail below, and may also be enhanced by selecting a low coefficient of thermal expansion material for the rotor (such that axial expansion of the rotor is reduced) and by selecting a high coefficient of thermal expansion material for the stator (such that axial expansion of the stator may be increased), at least relative to one another. The use of the control system 42 to achieve reduction or elimination of blade tip clearances, particularly through axial movement of components of the turbomachine system 10 in the axial direction 30, will be described in detail below with reference to later figures.

Figure 4:
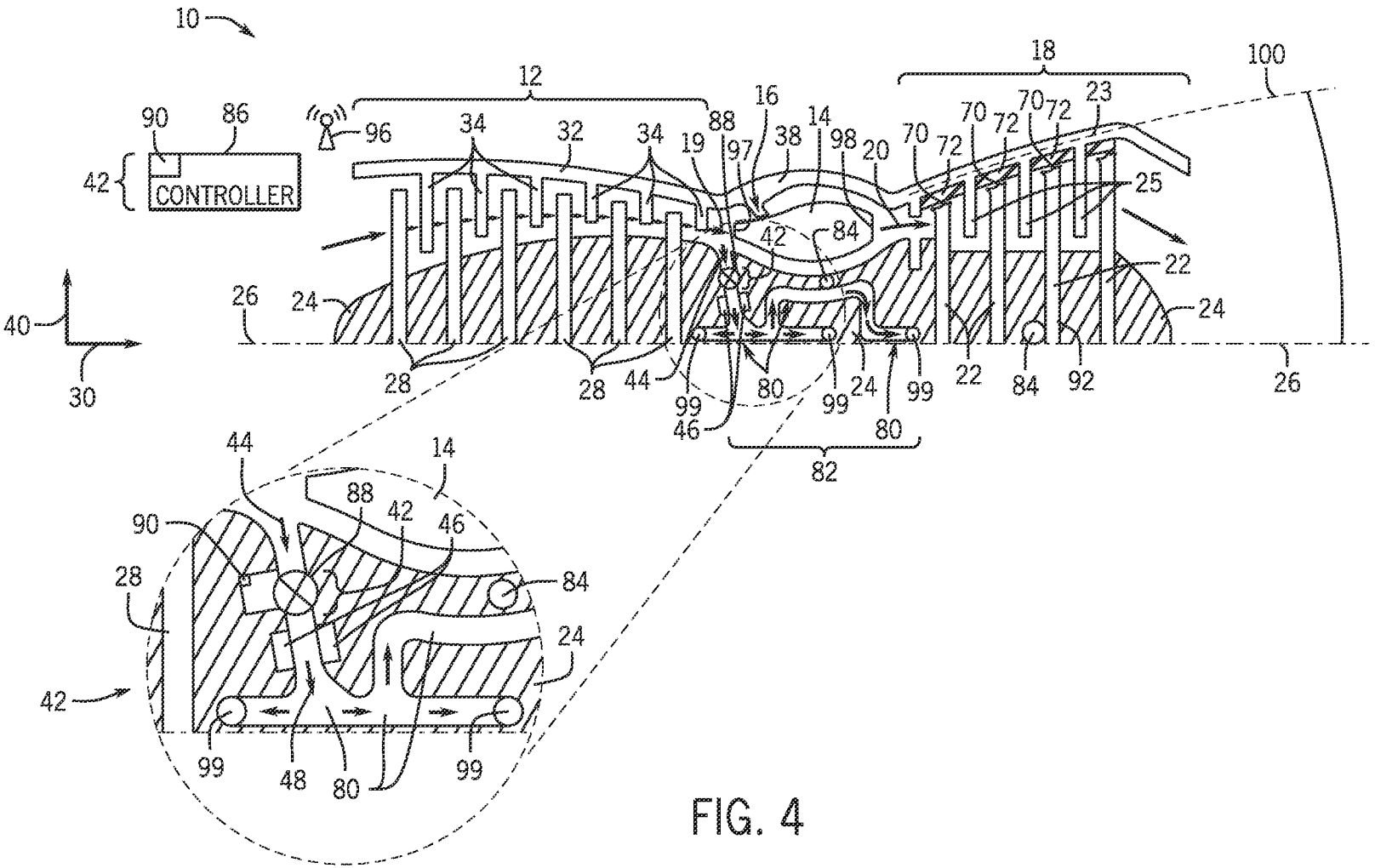
FIG. 4 is a cross-sectional side view of an embodiment of a turbomachine system having an axial displacement control system, in accordance with aspects of the present disclosure.

Turning now to FIG. 4, a cross-sectional side view of a portion of an embodiment of the turbomachine system 10 is shown. The illustrated embodiment of the turbomachine system 10 includes the rotor comprising the shaft 24, the compressor blades 28, and the turbine blades 22, along with a cooling area 80 (e.g., cooling channel or cooling cavity) running through a portion of the shaft 24 near a midsection 82 of the turbomachine system 10. The cooling area 80 may be used to cool the shaft 24 (of the rotor) via the control system 42, as previously described, and may be internal to the shaft 24, external to the shaft 24, or may include portions of both. Also included in the illustrated embodiment is the stator, comprising the compressor shroud 32, the compressor vanes 34, the turbine shroud 23, and the turbine vanes 25. The optional transition shroud 38 is also shown, although the transition shroud 38 may actually be a part of the compressor shroud 32 and/or a part of the turbine shroud 23. Indeed, all three of the shrouds 23, 32, and 38 may be one integral shroud used as a casing for the stator of the turbomachine system 10.

As previously described, air (or other coolants, such as an inert gas (e.g., nitrogen, steam, liquid, vapor, etc.) external to the turbomachine system 10 is drawn into the compressor 12 and is compressed via the compressor vanes 34 and compressor blades 28 to generate compressed air 19. The compressed air 19 is delivered to the combustors 14 (one shown), along with fuel from the fuel nozzle 16. The combustor 14 combusts the compressed air 19 to generate combustion gases 20, which are routed through the turbine blades 22 of the turbine 18 for driving the turbine blades 22 into rotation. The turbine blades 22 are coupled to the shaft 24, such that the turbine blades 22 drive the shaft 24 into rotation, which, in turn, drives the compressor blades 28 into rotation.

Some of the compressed air 19 generated by the compressor 12 may be diverted from the combustors 14. For example, the portion 44 of compressed air 19 is diverted away from the combustors 14 via the control system 42. The control system 42 may include one or more sensors 84, a controller 86, and a valve 88, where the one or more sensors 84 may be configured to detect pressure, temperature, light, vibration, noise, combustion dynamics, or a combination thereof, all of which may be configured to indicate a need to increase or decrease clearance. The controller 86 may be included with, or may be a part of, a processor and may include memory 90 with executable instructions stored on the memory 90. For example, the controller 86 may include executable instructions which, when executed, determine if, when, and/or how much of the compressed air 19 may be diverted from the combustor 14. The controller 86 may instruct the valve 88 to open fully, or to a certain degree, such that an appropriate amount of the compressed air 19 is diverted from the combustors 14. Thus, the portion 44 of diverted compressed air 19 may be appropriately cooled via the heat exchanger(s) 46 and routed through or proximate rotor components (e.g., the shaft 24) for cooling the rotor components.

The controller 86 may accept input data from one or more of the sensors 84, which may provide data to the controller 86 relating to operation conditions of the turbomachine system 10. Operating conditions may include, for example, temperature of various components of the turbomachine system 10, axial displacement measurements of various components of the turbomachine system 10 (e.g., the shaft 24), or stages of operation of the turbomachine system 10. Stages of operation may include cold start (CS) (e.g., when the turbomachine system 10 is first started), full speed no load (FSNL) (e.g., when the turbomachine system 10 is at full speed but not connected to the load 36), full speed full load (FSFL) (e.g., when the turbomachine system 10 is at full speed and is just connected to the load 36), steady state (SS) (e.g., when the turbomachine system 10 is no longer in transient operation), shutdown, or some other transient or steady state stage or condition. The sensors 84 may also detect axial displacement of turbine components and provide data related to the axial displacement of the turbine components to the controller 86. For example, one sensor 84 may be disposed on the shaft 24 proximate a third stage turbine blade 92 of the turbine 18. The sensor 84 may detect axial displacement of the shaft 24 where the sensor 84 is located (e.g., proximate the third stage turbine blade 92) relative to a home position of the sensor 84 (e.g., in the axial direction 30). The home position of the sensor 84 (e.g., along the rotational axis 26) may be a location of the sensor 84 when the turbomachine system 10 is off-line. Thus, when the turbomachine system 10 begins to operate, the sensor 84 may detect axial displacement of the shaft 24 relative to the home position of the sensor 84 along the rotational axis 26 and relay information related to the axial displacement to the controller 86. The controller 86 may then determine if, when, and/or how much of the compressed air 19 should be diverted to the cooling area 80 for cooling the shaft 24 or other rotor components proximate the cooling area 80. Additionally, based on feedback from the sensors 84 (or based on some other input information), the controller 86 may determine when to block compressed air 19 from being diverted to the cooling area 80 for cooling the shaft 24 or other rotor components proximate the cooling area 80, such as when the blade tips 70 are already contacting the honeycomb structure 72.

The controller 86 is coupled to the sensors 84, the valve 88 (e.g., via actuators or drivers), and/or the heat exchangers 46 (e.g., via valves or other controls). Thus, the controller 86 may control operation of any one or more of the sensors 84, valve 88, and heat exchangers 46. The controller 86 may be capable of controlling any facet of the valve 88 (e.g., if and when to open the valve 88, to what extent to open the valve 88, etc.) and any facet of the heat exchangers 46 (e.g., to what extent to cool the diverted portion 44 of compressed air 19). The controller 86 may also be capable of receiving data input(s) from any one or more of the sensors 84 for determining how to appropriately control the valve 88 and/or heat exchangers 46. The controller 86 may also receive a manual input from an operator. The controller 86 may be electrically coupled to the sensors 84, valve 88, and heat exchangers 46, or the controller 86, sensors 84, valve 88, and heat exchangers may be coupled to a network 96 (e.g., Internet, intranet, industrial control network, etc.) or other wired or wireless system, such that information and instructions may be shared between the components via the network 96. Further, in some embodiments, the controller 86 and the valve 88 may be an integral component or physically coupled together in close proximity to one another. It should also be noted that, in some embodiments, the controller 86 may not be coupled to the heat exchanger(s) 46. Accordingly, in some embodiments, the heat exchanger(s) 46 may cool the diverted portion 44 of compressed air 19 to the same extent at any time, once the portion 44 is allowed to pass through the valve 88.

After determining that blade tip clearances may be reduced or eliminated via cooling of rotor components (in particular, the shaft 24), the controller 86 may open the valve 88. The controller 86 may, for example, enable rotor cooling when the turbomachine system 10 is at a certain stage of operation. For example, after the turbomachine system 10 is at full speed no load (FSNL), blade tip clearances may be high or increasing, which enables hot combustion gases 20 to leak over the tips 70 of each turbine blade 22. Accordingly, the controller 86 may enable rotor cooling after reaching FSNL by opening the valve 88. The same may be true when the turbomachine system 10 is at full speed full load (FSFL), steady state (SS), or cold start (CS), or any other stage of operation, if conditions so permit. In general, the controller 86 is configured to control flow of coolant (e.g., compressed air, steam, refrigerant, or some other gas, liquid, or vapor) through the heat exchanger(s) 46, which in turn controls a degree of cooling of components of the turbomachine 10.

The portion 44 of compressed air 19 may then be diverted into the cooling area 80, where the heat exchangers 46 cool the portion 44 of compressed air 19 to generate the cooled compressed air 48. The cooled compressed air 48 may be routed through the cooling area 80, which may be defined in part by one or more components of the rotor. In the illustrated embodiment, the cooling area 80 is defined entirely within the shaft 24 of the rotor, and extends below the combustor 14 from (or just beyond) a first end 97 of the combustor 14 to (or just beyond) a second end 98 of the combustor 14. It should be noted that the first end 97 of the combustor 14 may be a first end of a chamber of the combustor 14, but that other components of the combustor 14 (e.g., fuel injectors) may extend opposite the axial direction 30 beyond the cooling area 80. Further, in the illustrated embodiment, the cooling area 80 includes portions directing the cooled compressed air 48 backwardly toward the compressor 12 (e.g., opposite the axial direction 30). The cooling area 80 also includes portions directing the cooled compressed air 48 forwardly toward the turbine 18 (e.g., in the axial direction 30). Further still, the cooling area 80 (e.g., cooling channel) may have outlets 99, such that the cooled compressed air 48, after extracting heat therefrom, for example, the shaft 24, may exit the shaft 24 of the turbomachine 10. In other embodiments, the cooling area 80 may be external to the shaft 24 and/or the cooling area 80 may contact or be disposed proximate other components of the rotor. Indeed, the cooling area 80 may be a channel, or a series of channels. Alternatively, the cooling area 80 may be an internal area of, for example, one or more rotor components, where the internal area may be defined by other features of the rotor component(s).

Further, the cooling area 80, depending on the embodiment, may be disposed in particular locations of the turbomachine 10. For example, in some embodiments, the cooling area 80 may be disposed proximate final stages (e.g., compressor blade 28 stages) of the compressor 12 and/or proximate initial stages (e.g., turbine blade 22 stages) of the turbine 18. However, in some embodiments, the cooling area 80 may be disposed substantially proximate only rotor components, or mostly only rotor components, and in particular the shaft 24 of the rotor. Thus, the shaft 24 may be cooled, when appropriate, such that the shaft 24 is blocked from thermally expanding too much in the axial direction 30. Otherwise, the blade tips 70 may be axially displaced in the axial direction 30, away from the honeycomb structures 72, such that blade tip clearances are increased. Further, the cooling area 80 may, in some embodiments, not extend very far into the turbine 18, if at all, as cooling of rotor components within the turbine 18 (e.g., turbine blades 22) may radially contract the turbine blades 22 away from the turbine shroud 23 and toward the shaft 24, which increases blade tip clearances.

It should be noted that it may be desirable, as described above, to enable cooling via the control system 42 at certain operating intervals or conditions in order to reduce blade tip clearances, but that it may also be desirable to block cooling of rotor components via the control system 42 to block a reduction in blade tip clearances in certain other operating intervals or conditions. Put differently, if the tips 70 are already cutting into the honeycomb structure 72, it may be beneficial to block cooling such that the tips 70 do not eventually cut into a component radially outward from the honeycomb structure 72, such as the turbine shroud 23. For example, in one embodiment, during start up or shutdown (e.g., transient stages or conditions), it may be beneficial to block coolant from cooling rotor components. During steady state stages or conditions, it may be beneficial to enable coolant to cool rotor components. Alternatively, in another embodiment, during start up or shutdown (e.g., transient stages or conditions), it may be beneficial to enable coolant to cool rotor components. In such an embodiment, during steady state stages or conditions, it may be beneficial to block coolant from cooling rotor components.

In some embodiments, the cooling area 80 may be disposed proximate some stator components. However, in general, the cooling area 80 is disposed mostly proximate rotor components. Indeed, blade tip clearances may be further reduced by ensuring that the stator, as described above, and in particular the turbine shroud 23 and the honeycomb structures 72 disposed on the turbine shroud 23, thermally expands in the axial direction 30, into or toward the tips 70 of the turbine blades 22. Indeed, as indicated by line 100 in the illustrated embodiment, the turbine shroud 23 (and the turbine 18 in general) opens up in the axial direction 30 along the rotational axis 26. In other words, the line 100 (e.g., slope) extending through the turbine shroud 23 is sloped relative to the rotational axis 26, such that a cross-sectional area of the turbine 18 increases in the axial direction 30. Thus, blade tip clearances may be reduced or eliminate by axially displacing, or preventing axial displacement, of certain components due to the slope 100 of the turbine shroud 23. For example, by contracting or blocking axial displacement (e.g., by cooling) of the shaft 24 in the axial direction 30 and, thus, the blades 22 (having blade tips 70) coupled to the shaft 24, the blade tips 70 are blocked from separating from the honeycomb structures 72 disposed along the slope 100 of the turbine shroud 23. Further, by effecting axial displacement (e.g., through thermal expansion) of the turbine shroud 23 in the axial direction 30, the turbine shroud 23, since it is sloped along line 100, thermally expands into or toward the blade tips 70. By controlling rotor cooling and stator heating (e.g., via the control system 42) either simultaneously or independently during various stages of operation, blade tip clearances may be reduced or eliminated, when appropriate.

It should be noted, however, that the honeycomb structure 72 may or may not follow the slope 100. For example, in the illustrated embodiment, the honeycomb structure 72 is conical in accordance with the description above. However, in some embodiments, the honeycomb structure 72 may be cylindrical. In such embodiments, the blade tips 70 may contact a first portion of the honeycomb structure 72 during transient loading, and a second, untrenched portion of the honeycomb structure during steady state loading. The blade tips 70 may contact different portions of the honeycomb structure 72 via axial thermal displacement (e.g., via cooling/heating) of stator and/or rotor components, in accordance with the present disclosure.

Figure 5:
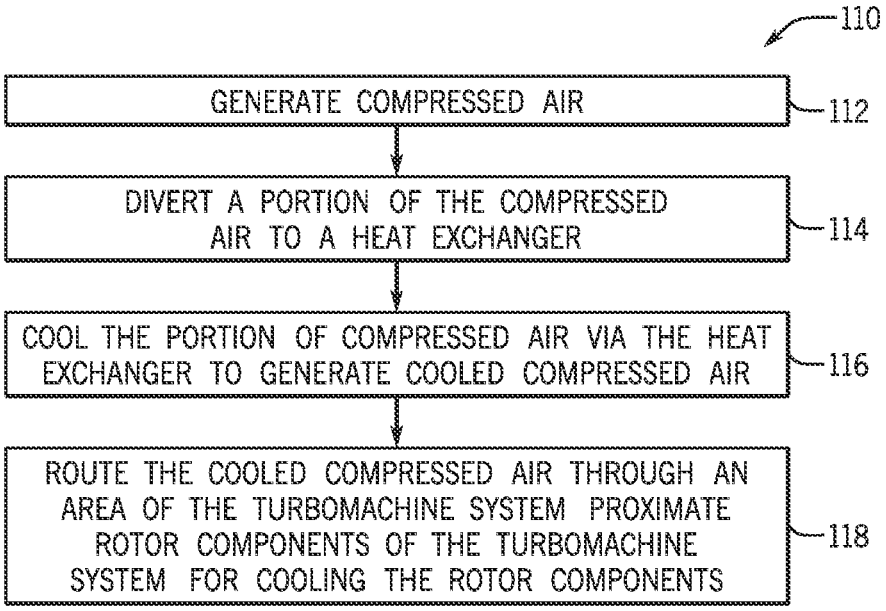
FIG. 5 is a process flow diagram of a method for controlling blade tip clearances, in accordance with aspects of the present disclosure.

Turning now to FIG. 5, a process flow diagram of a method 110 for reducing blade tip clearances is shown. The illustrated method 110 includes generating compressed air 19 (block 112) and diverting the portion 44 of the compressed air 19 to the heat exchanger 46 (block 114). The compressed air 19 may be generated by the compressor 12 of the turbomachine system 10 and the portion 44 of compressed air 19 may be diverted to the heat exchanger 46 via the valve 88, as previously described, which may be controlled by the controller 86. The method 110 further includes cooling the portion 44 of the compressed air 19 via the heat exchanger 46 to generate cooled compressed air 48 (block 116). Further still, the method 110 includes routing the cooled compressed air 48 through an area of the turbomachine system 10 for cooling rotor components of the turbomachine system 10 (block 118). The area is disposed proximate the rotor components and extends proximate the compressor 12 of the turbomachine system 10. The area is disposed proximate the rotor components such that the rotor components may be cooled, which reduces an axial displacement of the rotor components. Reducing the axial displacement of the rotor components may reduce blade tip clearances between turbine blades 22 and the turbine shroud 23 (or the honeycomb structure 72 disposed on the turbine shroud 23).

In accordance with the present disclosure, decreasing blade tip clearances via controlling axial displacement of components of the turbomachine system 10 may reduce leakage of combustion gases over the tips 70 of the turbine blades 22. Further, utilizing the presently discloses control system 24 to do so, as opposed to using a hydraulic or actuation displacement mechanism, may save material cost and complexity of manufacturing. Further still, by ensuring that cooling of rotor components does not extend too far into the turbine 18, the rotor components may be blocked from thermal expansion in the axial direction 30 while the turbine blades 22 do not contract away from the turbine shroud 23 toward the shaft 24.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a turbomachine rotor comprising a shaft and turbomachine blades coupled to the shaft;

a turbomachine stator comprising a shroud surrounding the turbomachine blades of the turbomachine rotor; and a cooling channel having at least a first portion of the cooling channel positioned upstream of a final stage of a compressor of the system, wherein the cooling channel is configured to receive cooled compressed air from the compressor and direct the cooled compressed air adjacent to the turbomachine rotor to reduce thermal expansion and/or axial displacement of the turbomachine rotor, and wherein the first portion of the cooling channel is positioned upstream of the final stage of the compressor so as to cool the turbomachine rotor upstream of the final stage of the compressor.

2. The system of claim 1, comprising a heat exchanger positioned in the turbomachine rotor, wherein the heat exchanger is configured to receive a compressed air and to cool the compressed air to generate the cooled compressed air.

3. The system of claim 1, comprising a valve and a heat exchanger, wherein the valve is configured to enable a portion of compressed air to be diverted to the heat exchanger, and the heat exchanger is configured to cool the portion of compressed air to generate the cooled compressed air.

4. The system of claim 3, comprising a controller configured to regulate operation of the valve to control flow of the portion of compressed air to the heat exchanger.

5. The system of claim 4, comprising a sensor configured to detect one or more operating conditions of the system and transmit information relating to the one or more operating conditions to the controller, wherein the controller is configured to receive the one or more operating conditions from the sensor, and the controller is configured to regulate operation of the valve based on the information received from the sensor, based on a manual input, or both.

6. The system of claim 5, wherein the one or more operating conditions comprise a temperature, a pressure, a stage of operation, or a combination thereof, and wherein the stage of operation comprises a general transient stage, a general steady state stage, a cold start stage, a full speed no load stage, a full speed full load stage, a steady state stage, a shutdown stage, or any combination thereof.

7. The system of claim 1, wherein the turbomachine rotor comprises a first material, the turbomachine stator comprises a second material, and the first and second materials are different.

8. The system of claim 1, comprising a combustor chamber, wherein the cooling channel extends proximate the combustor chamber from a first end of the combustor chamber to a second end of the combustor chamber opposite the first end.

9. A method for reducing blade tip clearances of a turbomachine, comprising:

diverting a first portion of compressed air to a heat exchanger during certain stages of operation of the turbomachine;

cooling the first portion of compressed air via the heat exchanger to generate a cooled compressed air;

routing the cooled compressed air through a channel proximate a rotor of the turbomachine, wherein the channel includes at least a first portion of the channel extending upstream of a final stage of a compressor of the turbomachine; and cooling the rotor to effectuate a reduction in thermal expansion and/or axial displacement of the rotor to reduce a blade tip clearance between a blade of the turbomachine and a stator of the turbomachine.

10. The method of claim 9, comprising generating the compressed air via the compressor and diverting the first portion of the compressed air to the heat exchanger via a valve.

11. The method of claim 10, comprising opening or closing the valve to permit the first portion of compressed air to be diverted to the heat exchanger via a controller.

12. The method of claim 11, comprising sensing one or more operating conditions via a sensor and transmitting information relating to the one or more operating conditions from the sensor to the controller, wherein the controller is configured to open or close the valve based on the information relating to the one or more operating conditions, based on a manual input, or both.

13. The method of claim 12, wherein the one or more operating conditions comprise a temperature, a pressure, a stage of operation, or a combination thereof, and wherein the stage of operation comprises a general transient stage, a general steady state stage, a cold start stage, a full speed no load stage, a full speed full load stage, a steady state stage, a shutdown stage, or any combination thereof.

14. The method of claim 12, comprising combusting a second portion of compressed air in a combustor for generating combustion products and heating the stator of the turbomachine via the combustion products, wherein heating the stator of the turbomachine via the combustion products effectuates thermal expansion and axial displacement the stator, wherein the axial displacement of the stator controls the blade tip clearance between the blade of the turbomachine and the stator of the turbomachine.

15. The method of claim 14, wherein the rotor comprises a first material having a low coefficient of thermal expansion and the stator comprises a second material having a high coefficient of thermal expansion.

16. A turbomachine system, comprising:

a turbomachine rotor comprising a shaft and turbomachine blades coupled to the shaft;

a turbomachine stator comprising a shroud surrounding the turbomachine blades of the turbomachine rotor;

a cooling channel having at least a first portion of the cooling channel extending upstream of a final stage of a compressor of the turbomachine system, wherein the cooling channel is configured to receive cooled compressed air from the compressor and direct the cooled compressed air adjacent to the turbomachine rotor to reduce thermal expansion and/or axial displacement of the turbomachine rotor; and a control system configured to selectively enable fluid communication between the compressor and the cooling channel, the control system comprising:

a valve disposed between the compressor and the cooling channel, wherein the valve is configured to be selectively opened to enable fluid communication between the compressor and the cooling channel based on an operating condition of the turbomachine system;

a sensor disposed proximate the cooling channel and configured to detect a parameter relating to the operating condition of the turbomachine system; and a controller configured to receive the parameter relating to the operating condition of the turbomachine system and, based on the operating condition, selectively open or close the valve to enable fluid communication between the compressor and the cooling channel.

17. The turbomachine system of claim 16, wherein the parameter comprises a temperature, a pressure, a stage of operation, or a combination thereof, and wherein the stage of operation comprises a general transient stage, a general steady state stage, a cold start stage, a full speed no load stage, a full speed full load stage, a steady state stage, a shutdown stage, or any combination thereof.

18. The turbomachine system of claim 16, comprising a heat exchanger disposed between the compressor and the cooling channel, wherein the heat exchanger is configured to cool compressed air from the compressor to generate the cooled compressed air.

19. The turbomachine system of claim 16, comprising a combustion chamber, wherein the cooling channel extends from a first end of the combustion chamber to a second end of the combustion chamber.

20. The turbomachine system of claim 16, wherein the cooling channel comprises a forward flow portion configured to route the cooled compressed air toward a turbine of the turbomachine system in a first direction, the cooling channel comprises a backward flow portion configured to route the cooled compressed air toward a compressor of the turbomachine system in a second direction, and the first direction is substantially opposite to the second direction.

* * * * *